United States Patent [19]

Muller et al.

[11] 4,016,189

[45] Apr. 5, 1977

[54] PROCESS FOR PRODUCING A GAS WHICH CAN BE SUBSTITUTED FOR NATURAL GAS

[75] Inventors: Wolf-Dieter Muller, Frankfurt am Main; Friedrich-Wilhelm Moller, Friedrichsdorf; Heinz Jockel, Klein-Gerau, all of Germany

[73] Assignee: Metallgesellschaft Aktiengesellschaft, Frankfurt am Main, Germany

[22] Filed: July 22, 1975

[21] Appl. No.: 598,085

[30] Foreign Application Priority Data

July 27, 1974 Germany ..... 2436297

[52] U.S. Cl. ..... 260/449.6 M; 260/449 S; 48/196 R; 48/197 R; 260/449 M; 260/449.6 M

[51] Int. Cl.[2] ..... C07C 1/04

[58] Field of Search ..... 260/449 M, 449.6 M, 260/449 S; 48/197, 196

[56] References Cited

UNITED STATES PATENTS

| | | | |
|---|---|---|---|
| 2,051,774 | 8/1936 | Kleinschmidt | 260/449.5 |
| 2,301,687 | 11/1942 | Dorschnel | 260/449 M |
| 3,511,624 | 5/1970 | Humphries et al. | 260/449 M X |
| 3,890,113 | 6/1975 | Child et al. | 260/449 M X |
| 3,922,148 | 11/1975 | Child | 260/449 M |
| 3,928,001 | 12/1975 | Child et al. | 260/449 M X |

*Primary Examiner*—Howard T. Mars

*Attorney, Agent, or Firm*—Burgess, Dinklage & Sprung

[57] ABSTRACT

A gas which can be substituted for natural gas is produced from a raw gas containing hydrogen and carbon oxides which is produced by the gasification of coal, tar or heavy residual oils under superatmospheric pressure. The raw gas is cooled, purified to remove catalyst poisons, particularly sulfur compounds, and then subjected to methanation and at least two stages in contact with nickel catalysts under pressures of 5–100 bars and at temperatures in the range of 200°–500° C. The product gas from the preceding methanation stage is reacted in the last methanation stage in contact with a catalyst which is indirectly cooled by a gas flowing in a countercurrent to the gas to be reacted.

5 Claims, 4 Drawing Figures

14
17
STEAM
15
WATER 7
4
7a
METHANATION
13
16
12
6
6a
10
2
3
3
3
3
5
9
8
LAST
METHANATION
18
11
7
19
20
1
RAW
GAS
PRODUCT GAS
22
21

17
14
STEAM
15
WATER 7
4a
RAW
GAS
13
16
7a
METHANATION
A1
40
30
6
6a
5
35
36
LAST
METHANATION
10
9
37
38
8
12
31
39
34
11
7
32
33
PRODUCT
GAS
22
21
20

(°C)
300
200
100
0
F
F'
N
E
E'
D
B
C
C'

(°C)
400
300
200
100
M
G
L
H
K

PROCESS FOR PRODUCING A GAS WHICH CAN BE SUBSTITUTED FOR NATURAL GAS

BACKGROUND

This invention relates to a process of producing a gas which can be substituted for natural gas and which is produced from a raw gas that contains hydrogen and carbon oxides and has been produced by a gasification of coal, tar or heavy residual oils under superatmospheric pressure, in which process the raw gas is cooled, purified to remove catalyst poison, particularly sulfur compounds, and then subjected to methanation in at least two stages in contact with nickel catalysts under pressures of 5–100 bars and at temperatures in the range of 200°–500° C.

It is known that coal, tar, and heavy residual oil can be degasified with water vapor and oxygen under superatmospheric pressure and at elevated temperatures to produce a raw gas which contains carbon oxides in excess of its hydrogen content. The raw gases produced by the gasification of coal with water vapor and oxygen under a pressure of 20–80 bars generally have a high $CO_2$ content (28–32% by volume) and CO content (15–20% by volume) and a relatively low $H_2$ content (35–44% by volume). The gasification of tars and residual oils is carried out at higher temperatures of about 1100°–1500 ° C than the gasification of coal and results in a raw gas which contains 3–6% by volume $CO_2$, 46–50% by volume CO, and 40–48% by volume $H_2$. Heavy residual oils are hydrocarbons which boil above 250 ° C.

The raw gases which have been purified mainly to remove all sulfur compounds may be converted by known single- or multi-stage methanation processes with the aid of nickel catalysts to form gases which contain at least 90% by volume methane (calculated as $CO_2$-free gas) and which can be substituted for or mixed with natural gas. The hydrogen content of these gases should not exceed 2% by volume and hydrogen contents below 1% by volume are often required. The gas contains in most cases inert components consisting of nitrogen, argon, and residual carbon dioxide.

By the methanation, the oxides of carbon are catalytically reacted with hydrogen to form methane and water vapor by the following exothermic reactions:

$$CO + 3\ H_2 = CH_4 + H_2O$$

$$CO_2 + 4\ H_2 = 3\ CH_4 + 2H_2O.$$

From thermodynamic laws it is known that the reaction temperatures should be as low as possible in order to produce a gas having a high methane content and low contents of residual carbon oxide and hydrogen. For this reason a large proportion of the water vapor formed in the preceding reaction stages must be removed from the gas before the same is passed through the last catalyst bed so that the formation of additional methane at a given temperature is promoted.

In a known process the scrubbed raw gas is first reacted in a so-called recycling methanation stage, which is left by the gas at a relatively high temperature. In this stage the activity of the nickel catalyst at temperatures above about 280° C is utilized. Part of the product gas from this methanation stage is cooled in a waste heat boiler and is then recycled to the inlet of this stage in order to dilute the feed gas. This recycling methanation stage may comprise a plurality of stages in an arrangement in which the raw gas is divided into a plurality of partial streams and passed through reactors connected in series, the gas which leaves the first reactor serving as a diluent gas for the second reactor and part of the product gas from the last reactor being recycled to serve as diluent gas for the first reactor.

Owing to the equilibrium which results at the relatively high temperature, the product gas which has formed in the recycling methanation stage still contains a considerable proportion of hydrogen, which can be reacted with additional carbon oxides to form methane only at lower temperatures. For this reason it is known to cool the product gas from the recycling methanation stage and to subject the cooled gas to a first aftermethanation in a so-called wet aftermethanation stage without a previous removal of water vapor from the gas. Because the wet methanation does not result in a product gas having the desired methane content, it is also usual to cool the resulting gas, to remove by condensation a major part of the water vapor contained in the gas, then to reheat the gas and to pass it again over nickel catalysts. This so-called dry aftermethanation stage produces the desired gas which can be substituted for natural gas when surplus $CO_2$ gas been scrubbed out.

In some cases the wet aftermethanation stage is omitted and the product gas withdrawn from the recycling stage is directly cooled, water vapor is condensed out of the gas, and the latter is then subjected to the dry aftermethanation. This practice results in a product gas which has a lower methane content and enables only a lower recovery of heat of reaction which has been liberated. For this reason, the overall thermal efficiency of the plant is lower than with the process described first. Besides, owing to the low water vapor content and the relatively high temperature of the gas leaving the aftermethanation stage result the risk of a formation of carbon black by the Boudouard reaction is much higher than in the process in which a wet aftermethanation and a dry aftermethanation are carried out in succession.

This invention simplifies methanation in a process of the kind defined first hereinbefore and omits a removal of water vapor by condensation before the last methanation stage. At the same time the heat of reaction should be utilized to a higher degree. This is accomplished according to the invention in that the product gas from the preceding methanation stage is reacted in the last methanation stage in contact with a catalyst which is indirectly cooled by a gas flowing in a countercurrent to the gas to be reacted. The cooling with gas in the methanation reactor permits of a utilization of the catalyst at reaction temperatures which are as low as possible whereas adiabatic methanation stages are capable of a stable operation only at higher temperatures. Because even the last stage operates under wet methanation conditions, the residual gas may contain slightly more water vapor than where a dry methanation is performed, whereas the hydrogen content still remains below the upper limit to be observed.

DESCRIPTION

Because in the process according to the invention there is no need to preheat the gas when the water vapor has been condensed out before the gas is to be subjected to dry methanation, the need for expensive heat exchange means is eliminated. The lower pressure loss in the process according to the invention results in a higher discharge pressure of the end gas so that less energy is required for the usually necessary compression of the gas to be delivered into the distributing system. If surplus carbon dioxide must be scrubbed out of the end gas to meet a specified inert gas content, the higher pressure of the gas will promote the absorption of $CO_2$, particularly where physically acting absorbents are used. If the methanation according to the invention is carried out under such a high pressure that the end gas can be directly delivered into the gas-distributing system, the preceding gasification for producing the raw gas can be carried out under a lower pressure. In this case the gasification plant benefits from the saving of energy in that the gasifying agents, oxygen and water vapor, may be supplied under a lower pressure.

Another advantage resides in that the volume of catalyst required in the process according to the invention is lower than would be required for a wet aftermethanation stage and a dry aftermethanation stage.

According to a further feature of the invention, the cooling gas may consist of purified raw gas and the heated cooling gas is then fed to the preceding methanation stage, e.g., a recycling methanation stage. Alternatively, precooled product gas from the preceding methanation stage may be used as a cooling gas and is conducted in this case in the reactor of the last methanation stage in such a manner that the gas is used first to indirectly cool the catalyst and the heated cooling gas is then reacted in the catalyst.

The product gas to be reacted in the last methanation stage should desirably contain, on a dry basis, at least 60% by volume methane and 0.25–0.7 kg water vapor per standard $m^3$ of gas.

DESCRIPTION OF THE DRAWING

Flow schemes for the process according to the invention will be explained with reference to the drawing, in which.

Figure 1:
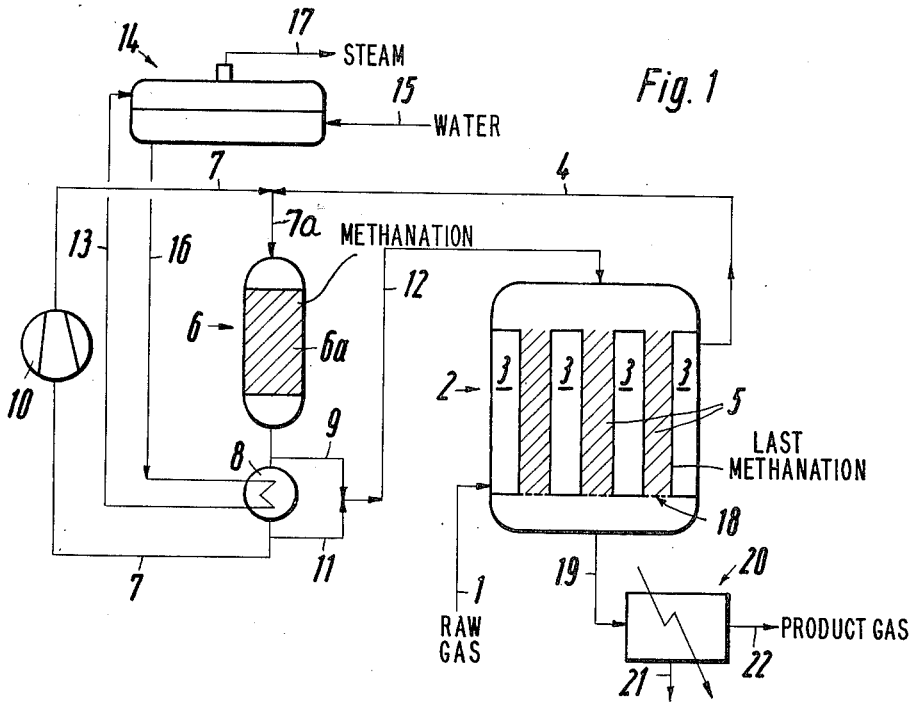
FIG. 1 shows the methanation of a purified raw gas which is used also as a cooling gas in the last methanation stage.

In the process shown in FIG. 1 a raw gas which mainly contains carbon monoxide, carbon dioxide, and hydrogen and which has been purified to remove catalyst poison is conducted in conduit 1 through the methanation reactor 2 as a cooling gas. The raw gas leaves a scrubber, not shown, at a temperature below 200° C and usually not in excess of 100° C. A gas which has been scrubbed by the Rectisol process (with cold methanol) will leave the scrubber at a temperature of about 20° C. In the reactor 2 the raw gas flows through the interconnected cooling elements 3 in the reactor 2 and leaves the latter in conduit 4. The raw gas in conduit 4 transfers heat which is composed of sensible heat and heat of reaction produced by the exothermic methanation reaction in the catalyst, which is represented by a hatched area 5. The methanation catalyst contains nickel as an active component, preferably in a proportion of 40–65% by weight, on a support which is resistant to water vapor. The support may consist, e.g., of alumina, aluminum silicate, magnesium silicate, magnesium spinel, or mixtues of these compounds.

The raw gas flowing in conduit 4 is mixed with product gas produced by the methanation in the reactor 6 and flowing in conduit 7. The mixture is fed in conduit **7*a* to the methanation reactor 6. As is diagrammatically shown on the drawing, the reactor 6 may consist of a shaft reactor which is packed with a catalyst represented by a hatched area 6*a*. The catalyst may be the same as that in reactor 2. The arrangement shown in FIG. 1 may be modified in that the catalyst 6*a*** is divided into a plurality of layers or arranged in a plurality of reactors connected in series.

Part of the product gas from the reactor 6 is cooled in the waste heat boiler 8. Uncooled product gas is branched off in conduit 9. Part of the cooled product gas is recycled with the aid of a compressor 10 in conduit 7. Behind the waste heat boiler 8, a partial stream of the product gas is branched off in conduit 11 and is mixed with the gas flowing in conduit 9 so that the gas is adjusted to the desired temperature before it is fed in conduit 12 into the last methanation stage (reactor 2). The gas enters the reactor 2 at a temperature of 250°–350° C.

In the waste heat boiler 8, heat is extracted from the product and serves to produce water vapor, which is conducted in conduit 13 to a steam header 14, which is fed with feed water in conduit 15. From the header 14, water is fed in conduit 16 to the waste heat boiler 8. Surplus steam is withdrawn from the header 14 through the conduit 17 and is available, e.g., as a gasifying agent for the pressure gasification by which the raw gas is produced.

The reactor 6 constitutes the main part of the recycling methanation stage. The product gas from said stage enters through conduit 12 the methanation reactor 2 and is reacted with the aid of the nickel catalyst 5. The catalyst is carried by grates 18 disposed between the cooling elements 3. The cooling action of the raw gas from conduit 1 is desirably adjusted so that the temperature of the gas to be reacted initially rises and then decreases toward the grates 18 because the temperature of the reacted gas leaving the reactor 2 should be as low as possible. The reaction temperature should rise in the upper portion of the catalyst bed, which portion has a height of about 0.2 to 0.4 time the total height of the catalyst bed. To this end, the cooling may be maintained, rendered ineffective, or reduced in that portion by means which are not shown, depending on the requirements imposed by the nature of the feed gas. This may be accomplished, e.g., in that the height of the elements 3, which height controls the cooling action, is as high as or lower than the height of the catalyst bed 5, or in that heat-lagging layers are provided in said portion of the cooling elements.

The product gas from the reactor 2 leaves the latter through the conduit 19 and is cooled in the cooling stage 20, which is also diagrammatically indicated and in which air cooling and water cooling usually supplement each other. This cooling results in a condensate, which is withdrawn in conduit 21. The product gas is conducted in conduit 22 and in case of need may be subjected to an aftertreatment, not shown, to remove surplus carbon dioxide and to dry the gas.

Figure 2:
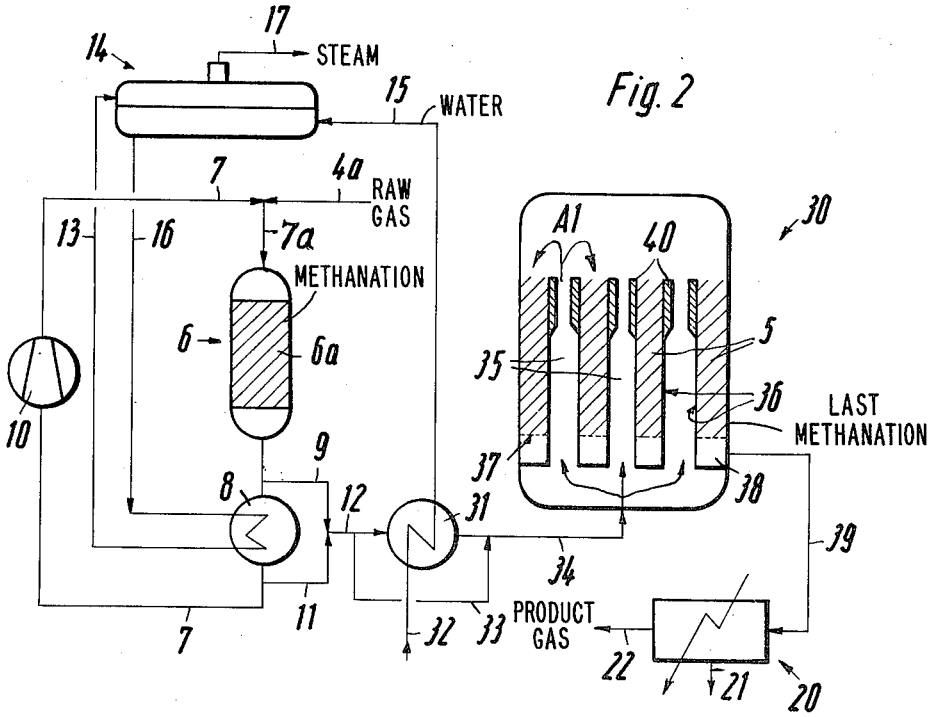
FIG. 2 shows a methanation process which is a modification of that of FIG. 1.

In the flow scheme shown in FIG. 2, parts shown also in FIG. 1 are designated by the same reference characters and the explanations given with reference to FIG. 1 in respect of such parts are also applicable to FIG. 2.

The recycling methanation stage which is shown in FIG. 2 and which comprises the reactor 6 differs from the one used in FIG. 1 only in that the purified raw gas is not used as a cooling gas in the last methanation stage but is conducted in conduit 4a and admixed to the product gas which is recycled in conduit 7. The last methanation stage of FIG. 2 is also different and comprises a reactor 30. Product gas conducted in conduit 12 from the recycling methanation stage is precooled in the heat exchanger 31 and the heat which is extracted serves to heat feed water coming from conduit 32. The preheated feed water is then fed in conduit 15 to the steam header 14.

A feature which is not essential but is desirable in practice resides in that an adjustable partial stream of uncooled product gas is conducted in a conduit 33, which bypasses the heat exchanger 31, and this partial stream is admixed to the partial stream consisting of the cooled product gas. In this way the gas can be adjusted to the enter the reactor 30 at the desired temperature. The precooled product gas flowing in conduit 34 enters the reactor 30 and is branched in the latter into passages 35 disposed between catalyst containers 36. The catalyst containers 36 are opentopped so that the gas to be reacted can freely enter the catalyst 5 at the top of the containers. This is indicated by the curved flow arrows A1. The plant provides for the pressure difference between the conduits 34 and 39 which is required for this purpose.

In the containers 36, the catalyst 5 is supported by grates 37. A gas-collecting chamber 38 is left under each grate 37. The gas-collecting chambers 38 of the several containers are interconnected by means which are not shown so that the product gas produced in the several containers can be withdrawn through the common conduit 39. This product gas is aftertreated as has been explained with reference to FIG. 1.

Each catalyst container 36 is provided in its uppermost portion with a shield 40, which prevents or at least substantially reduces the transfer of heat. As a result, the catalyst is not cooled in this region by the gas which rises in the passages 35 and the temperature of the gas to be reacted rises as the gas flows down in the catalyst. Between the grates 38 and the underside of the shields 40, the catalyst is cooled so that the temperatures decrease in this portion of the catalyst in the direction toward the grate. The height of the uncooled portion of the catalyst is about 0.2 to 0.4 time the height of the catalyst bed.

The temperature conditions of the gases in the reactor 2 will be explained with reference to FIG. 3. The temperature change of the gases in the reactor 30 will be explained with reference to FIG. 4. In the process shown in FIG. 1, relatively cold synthesis gas at, e.g., 25° C (point B in FIG. 3) enters the reactor 2 and as it flows through the cooling elements 3 is gradually heated to the temperature C, at which it leaves the reactor 2. The curve D-E-F is applicable to the gas to be reacted, which enters the reactor 2 from conduit 12. This gas is at a temperature D of about 330° C when it initially contacts the catalyst 5. This temperature is sufficiently higher than the lowest temperature of about 250° C at which the catalyst is active. As the gas to be reacted flows downwardly in the catalyst, the temperature in the catalyst rises first to the point E. Thereafter, the cooling action of the raw gas flowing in the cooling elements 3 is intensified so that the temperature of the gas flowing in the catalyst is gradually decreased as the gas approaches the grates 18. The temperature drop in the gas to be reacted results in a change of the equilibrium conditions of the methanation reactions in favor of the production of methane. Point F represents the temperature of the reacted gas which leaves the catalyst material. This gas collects in conduit 19.

Figure 3:
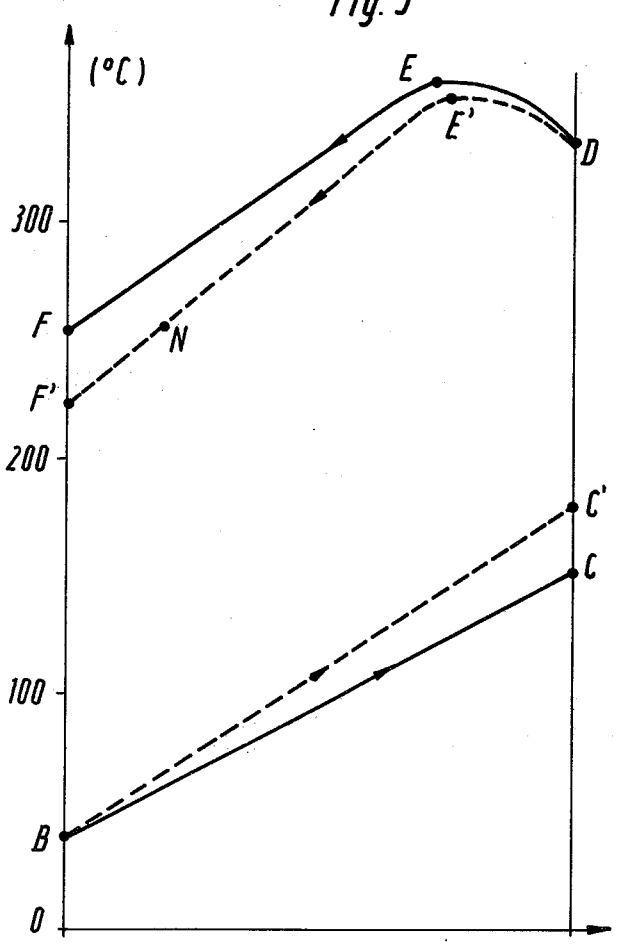
FIG. 3 represents the temperature change in the last methanation stage used in the process of FIG. 1

If the gas to be reacted is excessively cooled in the process of FIG. 1, its temperature curve, represented by a dotted line in FIG. 3, will have a more gently ascending portion terminating at point E′ and a more steeply descending portion terminating at point F′. The activity of the catalyst and the reaction cease at an intermediate point N so that the portion of the catalyst between this point and the grate is not utilized. The temperature range in which the catalyst has a low activity so that the reaction proceeds only at a low rate is reached too soon in this case so that the gas flowing in conduit 19 has a less satisfactory analysis than a gas which has been subjected to the temperature change represented by the curve portion E-F. This explanation shows clearly that it is important to provide for the catalyst a cooling which is sufficient and which can easily be adjusted to changing conditions. The dotted straight line B-C′ represents the temperature change of a gas which has an excessively high cooling effect.

Figure 4:
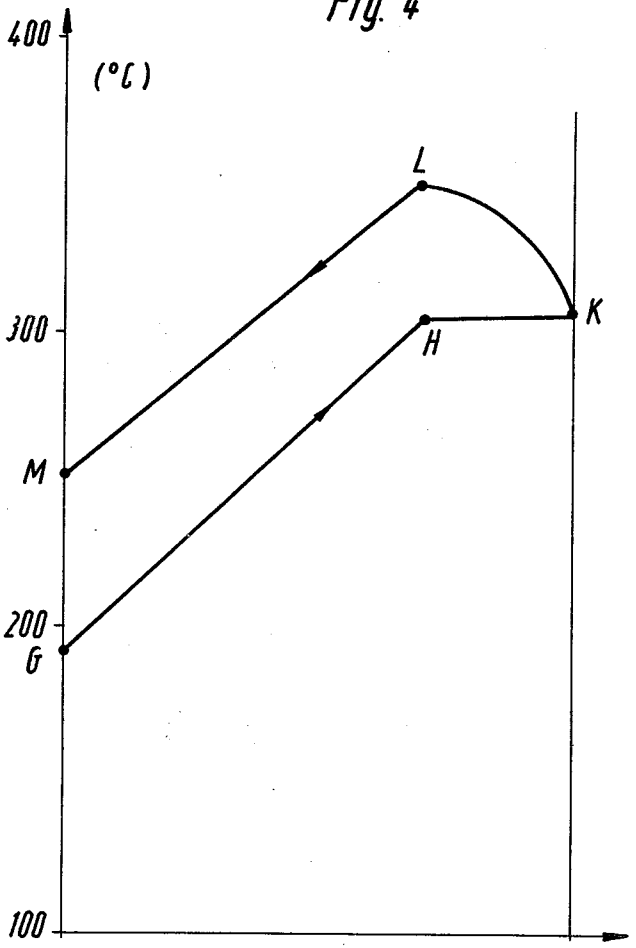
FIG. 4 represents the temperature change in the last methanation stage used in the process of FIG. 2.

In the process of FIG. 2, the product gas of the recycling methanizing stage is conducted in conduit 34 to the reactor 30 and enters the latter at the easily adjustable temperature G (FIG. 4). As the gas rises in the passages 35 it is heated to reach a temperature H at the underside of the shields 40. The temperature of the gas is not increased further as it flows along these shields; this is represented by the curve portion H-K. At the temperature K of about 300° C, the product gas then enters the catalyst containers 36 from above and flows through the catalyst to the grates 38 while the methanation reactions take place. The temperature of the gas mixture to be reacted rises first to the point L because the shields 40 prevent a dissipation of heat produced by the exothermic formation of methane. Thereafter, the indirect cooling decreases the temperature gradually to the point M, which represents the temperature of the product gas withdrawn through conduit 39.

The process of FIG. 2 is highly flexible because the inlet temperature of the gas to be reacted, which flows in conduit 34, can be adjusted in a simple manner, e.g., by the use of a by-pass conduit 33. With the temperature at which the gas enters the reactor 30, the cooling action of the gas flowing in passages 35 can also be adjusted. For this reason this inlet temperature of the gas influences also the end temperature of the reacted gas (point M) because M depends on the temperature at which the product gas enters. The flexible cooling permits of an optimum adjustment in consideration of the activity of the catalyst, which activity depends on the age of the catalyst. This remark is also applicable to the process of FIG. 1.

Each of the two following numerical examples relates to the use of the process according to the invention for converting three different purified raw gases into a substitute natural gas. Gases I and II have been produced by a pressure gasification of coal by a treatment with oxygen and water vapor. The volume ratio of $H_2$ : ($3\ CO + 4\ CO_2$), referred to as stoichiometric ratio, equals 0.6 in gas I and equals 1 in gas II. Gas III has been produced by a thermal gasification of heavy residual oil (bunker C oil) at temperatures between 1200° and 1400° C by a treatment with oxygen and water vapor.

EXAMPLE 1

In this example the three gases I, II, and III are processed in accordance with the flow scheme of FIG. 1. 1000 kilomoles (1 kilomole = 22.4 standard $m^3$) of each gas are fed in conduit 1 under a pressure of 25 bars and at a temperature of 30° C to the methanation reactor 2. The compositions of the gases are stated in Table 1.

Table 1

| | Gas I | Gas II | Gas III |
|---|---|---|---|
| $CO_2$ (mole percent) | 8.00 | 3.00 | 8.00 |
| CO (mole percent) | 16.00 | 17.20 | 27.30 |
| $H_2$ (mole percent) | 59.10 | 62.40 | 69.20 |
| $CH_4$ (mole percent) | 16.50 | 17.00 | 0.30 |
| Inert components (mole percent) | 0.40 | 0.40 | 0.20 |

These gases are heated in reactor 2 to temperatures of 150°/165°/135° C. (Successive temperature values relate to gas I/gas II/gas III; this abridged representation will be used also hereinafter.) The gases heated in reactor 2 are available in conduit 4. 4300/4650/6000 kilomoles of humid gas at temperatures of 325°/320°/320° C are delivered by the compressor 10 in conduit 7. The composition of the gas in conduit 7 is apparent from Table 2.

Table 2

| | Gas I | Gas II | Gas II |
|---|---|---|---|
| $CO_2$ (mole percent) | 13.44 | 3.54 | 23.89 |
| CO (mole percent) | 0.41 | 0.14 | 0.47 |
| $H_2$ (mole percent) | 7.92 | 11.78 | 8.58 |
| $CH_4$ (mole percent) | 77.33 | 83.60 | 66.47 |
| Inert components (mole percent) | 0.90 | 0.94 | 0.59 |
| $H_2O$ (mole per mole of dry gas) | 0.4475 | 0.4721 | 0.6542 |

The gases in conduits 4 and 7 are mixed so that 5300/5650/7000 kilomoles of humid gas at 300° C flow in conduit 7*a* to reactor 6.
The composition of this gas is apparent from Table 3.

Table 3

| | Gas I | Gas II | Gas III |
|---|---|---|---|
| $CO_2$ (mole percent) | 12.08 | 3.41 | 20.46 |
| CO (mole percent) | 4.31 | 4.24 | 5.19 |
| $H_2$ (mole percent) | 20.75 | 23.96 | 21.67 |
| $CH_4$ (mole percent) | 62.09 | 67.58 | 52.17 |
| Inert components (mole percent) | 0.77 | 0.81 | 0.51 |
| $H_2O$ (moles per mole of dry gas) | 0.3354 | 0.3585 | 0.5129 |

The catalyst in reactor 6 is a nickel catalyst, which contains 58% by weight nickel on an alumina support. The catalyst bed has a height of 2.65 m. The temperature of the product gas from reactor 6 is in all cases 460° C. The composition of this gas has already been stated in Table 2. Part of the gas from reactor 6 is adjusted in waste heat boiler 8 to a temperature of 315°/310°/310° C. Feed water at 105° C is fed in conduit 15 to steam header 17, in which 14,500/15,550/19,050 kg steam under a pressure of 70 bars are generated and are delivered to the consumers in conduit.

The gas which is available in conduit 12 for the reaction in reactor 2 is in all cases at a temperature of 330° C (point D in FIG. 3). The quantity of this (humid) gas is 643.0/627.4/557.3 kilomoles. As the gas enters the catalyst 5, the generation of heat by the exothermic methanizing reaction frist predominates over the cooling so that the temperature in the catalyst rises to about 360°/350°/365° C (point E in FIG. 3). As the gas continues to flow through the catalyst along a path having a total length of 4 m, the dissipation of heat to the cooling gas predominates so that the gas leaves the catalyst in all cases at a temperature of 250° C (point F in FIG. 3). The product gas is discharged in conduit 19. 3840/3610/4180 kg water are condensed in the final cooler 20. The product gas which leaves the methanation plant in conduit 22 in an amount of 412/383/311 kilomoles is in all cases under a pressure of 20.5 bars and at a temperature of 30° C and has the composition stated in Table 4

| | Gas I | Gas II | Gas III |
|---|---|---|---|
| $CO_2$ (mole percent) | 12.87 | 1.22 | 24.18 |
| CO (mole percent) | 0.01 | 0.01 | 0.01 |
| $H_2$ (mole percent) | 0.83 | 1.75 | 0.90 |
| $CH_4$ (mole percent) | 85.32 | 95.98 | 74.27 |
| Inert components (mole percent) | 0.97 | 1.05 | 0.64 |
| water vapor (moles per mole of dry gas) | 0.002 | 0.002 | 0.002 |

In the processing of gases I and III, surplus carbon dioxide must usually be removed in a final scrubber, not shown, so that end gases are produced which have the composition stated in Table 5.

Table 5

| | Gas I | Gas III |
|---|---|---|
| $CO_2$ | 0.50 | 0.50 |
| CO | 0.01 | 0.01 |
| $H_2$ | 0.95 | 1.17 |
| $CH_4$ | 97.43 | 97.47 |
| Inert components | 1.11 | 0.85 |

Gas II may be used without a removal of $CO_2$.

EXAMPLE 2

The same gases I, II and III which have been processed in Example 1 may be processed in accordance with the flow scheme of FIG. 2. 1000 kilomoles of each of these gases are available from conduit 4*a* at a temperature of 30° C and under a pressure of 25 bars. The composition of these gases is stated in Table 1 of Example 1. 4300/4650/6000 kilomoles of humid gas at a temperature of 345°/340°/330° C are fed in conduit 7 and admixed to the gas flowing in conduit 4*a*. The composition of the gas flowing in conduit 7 is stated in Table 2. The gas entering the reactor 6 has the same quantity and composition and is at the same temperature as in Example 1.

The catalyst in reactor 6 contains 58% by weight nickel on an alumina support. The catalyst bed has a height of 2.65 m. The product gas from reactor 6 has in all cases a temperature of 460° C and has the composition described in Example 1. A major part of the gas from reactor 6 is cooled to 335°/330°/320° C in waste heat boiler 8. Gas is withdrawn in conduit 12 in a quantity of 643.0/627.4/557.3 kilomoles (humid gas) and at a temperature of 350° C in each case and is further cooled to 195°/175°/195° C in the feed water preheater 31, in which the feed water fed in conduit 32 at a temperature of 105° C is heated to 175°/175°/150° C. The heated feed water is fed in conduit 15 to the steam header 14. The heat quantities delivered in the waste heat boiler 8 and the feed water preheater 31 result in an evaporation of 14,500/15,600/19,200 kg water, which are available in conduit 17 as saturated steam under a pressure of 70 bars.

Because the by-pass conduit 33 is not used in Example 2, the gases in conduit 34 are at a temperature of 195°/175°/195° C, represented by point G in FIG. 4. In the passages 35 of reactor 30, the gas is heated to a temperature of 300° C (point H in FIG. 4) in each case as it flows to the lower end of the shields. Heat cannot be exchanged along the heat-insulated portion of the flow path of the cooling gas so that the gas enters the catalyst 5 at the above-mentioned temperature of 300° C (point K in FIG. 4). The length of the flow path to be taken into account is equal to the height of the bed of the catalyst 5, which amounts also in all cases to 4 m. The same catalyst is used as in reactor 6. The uncooled flow path portion in catalyst has a length of 1 m. In this portion of the flow path, the temperature rises to the maximum value of 345°/350°/345° C (point L in FIG. 4). As the gas to be reacted leaves this flow path portion, it has a residual hydrogen content of 2.1/4.5/2.6 mole percent. The gas has now approximately the composition which can be obtained in a conventional process with a single wet aftermethanation stage.

As the gases flow through the cooled portion of the catalyst 5, their temperatures decrease as they approach the grates 37 until the reacted gases I, II, and III have reached the end temperature of 250° C (point M in FIG. 4). The gas at this end temperature is available in conduit 39. The further treatment in the final cooler 20 and in a succeeding $CO_2$ scrubber is the same as described in Example 1. The compositions of gases I, II, and III before and after the removal of $CO_2$ is stated in Tables 4 and 5 (Example 1).

What is claimed is:

1. In a process for producing a gas which can be substituted for natural gas from a raw gas containing hydrogen and carbon oxides produced by the gasification of coal, tar or heavy residual oils under superatmospheric pressure, wherein the raw gas is cooled, purified to remove catalyst poisons, particularly sulfur compounds, and then subjected to methanation in at least two stages in contact with nickel catalysts under pressures of 5–100 bars and at temperatures in the range of 200°–500° C, the improvement which comprises reacting the product gas from the preceding methanation stage in the last methanation stage in contact with a catalyst which is indirectly cooled by purified raw gas entering said last methanation stage at a temperature below 200° C and flowing therein countercurrent to the gas to be reacted.

2. Process of claim 1 wherein the catalyst comprises 40–65% by weight nickel on a support which is resistant to water vapor.

3. Process of claim 1 wherein the methanation is effected in two stages and the reaction is effected in the first methanation stage at a temperature of 250°–500° C and in the second stage at a temperature of 250°–400° C.

4. Process of claim 1 wherein the product gas fed from the preceding methanation stage to the last methanation stage contains, on a dry basis, at least 60% by volume methane and 0.25–0.7 kg water vapor per standard $m^3$ of gas.

5. In a process for producing a gas which can be substituted for natural gas from a raw gas containing hydrogen and carbon oxides produced by the gasification of coal, tar or heavy residual oils under superatmospheric pressure, wherein the raw gas is cooled, purified to remove catalyst poisons, particularly sulfur compounds, and then subjected to methanation in at least two stages in contact with nickel catalysts under pressures of 5–100 bars and at temperatures in the range of 200°–500° C, the improvement which comprises precooling the product gas from the methanation stage preceding the last methanation stage, said last methanation stage including a reaction zone with at least one catalyst zone and catalyst-free zones connected to said catalyst zone, feeding said precooled product gas into said catalyst-free zones of said reaction zone, said precooled gas flowing in the catalyst-free zones in countercurrent and with indirect heat exchange to the gas to be reacted in said catalyst zone, and feeding the gas from the catalyst-free zones into the catalyst zone to be reacted therein.

* * * * *

UNITED STATES PATENT AND TRADEMARK OFFICE

CERTIFICATE OF CORRECTION

PATENT NO. : 4,016,189

DATED : April 5, 1977

INVENTOR(S) : Wolf-Dieter Muller, et al

It is certified that error appears in the above-identified patent and that said Letters Patent are hereby corrected as shown below:

Column 7, line 33 - Table 2 - third column heading of table 2: "Gas II" should read --Gas III--

Signed and Sealed this

*ninth* Day of *August 1977*

[SEAL]

*Attest:*

RUTH C. MASON
*Attesting Officer*

C. MARSHALL DANN
*Commissioner of Patents and Trademarks*